US006659376B2

(12) United States Patent
Savard

(10) Patent No.: US 6,659,376 B2
(45) Date of Patent: Dec. 9, 2003

(54) SPREADING DEVICE FOR CONFINED APPLICATION OF GRAIN TYPE MATERIALS

(76) Inventor: Normand Savard, 1097, rue Normandie, Baie-Comeau, QBC (CA), G5C 3S7

( * ) Notice: Subject to any disclaimer, the term of this patent is extended or adjusted under 35 U.S.C. 154(b) by 200 days.

(21) Appl. No.: 09/849,280

(22) Filed: May 7, 2001

(65) Prior Publication Data

US 2001/0038046 A1 Nov. 8, 2001

Related U.S. Application Data

(60) Provisional application No. 60/202,123, filed on May 5, 2000.

(51) Int. Cl.[7] ..... A01C 15/00

(52) U.S. Cl. ..... 239/650; 239/668; 239/672; 291/25; 291/27

(58) Field of Search ..... 239/650–689; 291/25, 27, 20, 32, 33, 35, 38, 39

(56) References Cited

U.S. PATENT DOCUMENTS 1,165,331 A * 12/1915 Gray ..... 239/657
1,966,122 A * 7/1934 Hurt ..... 239/657
2,577,310 A * 12/1951 Connelly ..... 331/159
2,697,609 A * 12/1954 Chase et al. ..... 239/657
2,744,602 A * 12/1956 Sanderson ..... 239/657
3,235,268 A * 2/1966 McLean ..... 239/657
3,559,893 A * 2/1971 Gruben ..... 239/664
4,363,447 A 12/1982 Schulze
4,387,855 A 6/1983 Nielsen
4,773,598 A * 9/1988 Jones ..... 239/657
4,793,558 A 12/1988 Winkel et al.
5,058,811 A 10/1991 Vissers
5,286,158 A * 2/1994 Zimmerman ..... 239/650
5,669,531 A 9/1997 Hagemeyer
5,772,389 A * 6/1998 Feller ..... 239/657
6,446,879 B1 * 9/2002 Kime ..... 239/667

* cited by examiner

*Primary Examiner*—Dinh Q. Nguyen

(57) ABSTRACT

A spreading device for confined application of grain type materials along a well-defined path on a road from a conveyor of a storing tank mounted on a moving vehicle includes a chute member mounted thereon that receives the materials from the conveyor and substantially drops them generally vertically under gravity on the road along the path in proximity and in front of a roller. The latter stops the materials relative to the road and confines, or packs, them on the road. The spreading device is adapted to be mounted on either side of the vehicle, in line with its wheels.

14 Claims, 5 Drawing Sheets

SPREADING DEVICE FOR CONFINED APPLICATION OF GRAIN TYPE MATERIALS

CROSS REFERENCE TO RELATED APPLICATION

This application is related to U.S. provisional application for patent Serial No. 60/202,123 filed on May 5, 2000.

FIELD OF THE INVENTION

The present invention relates to devices for spreading grain type materials or the like on roads, and more specifically to a device installed or adapted on a spreading truck for confined application of these materials along a well-defined path on a roads.

BACKGROUND OF THE INVENTION

For Northerly countries, winters bring difficult situations onto the road network. A layer of ice or snow often covers the roadway suitable for motor vehicles. As it can be readily understood, this makes road transportation (of merchandise or of people) very dangerous. Winter security on roadways has therefore become an issue for all levels of governments, and especially their maintenance branches. Since they cannot forbid people to travel on roads but still want to avoid frequent occurrences of accidents, they have to make roadways as safe as possible, at all times. One way to keep roadways safe during winter times has been to spread on the roads a melting media, which can either be an abrasive, such as sand or crushed stones, or melting fluxes, such as calcium, salt, or a mix of the like, with salted water if required.

The most commonly used system for such a function has been a truck having a large capacity tank or bin, to hold the melting media, and equipped with a device to constantly and regularly convey amount of melting flux or mix to a rotary disk located below the truck above the roadway. With its centrifugal force this turbine-like rotary disk spreads the stone-like parts of the melting media all over a large perimeter.

Especially when melting fluxes (salt, calcium) are used as the melting media, problems have arisen. Firstly, those compounds are not environmentally friendly and can damage surrounding ecosystems and water reserves, but they are however necessary in some circumstances due to the fact that abrasive (sand, crushed stones) will not generally melt the ice. So in the end, the more effective ways melting fluxes are used, the better. One of the ways to increase melting fluxes' effectiveness, such as salt, is to spread it with a certain level of concentration. Unfortunately, the centrifugal system of the rotary disk disperses the media too much or on a too large surface for an effective melting operation. With that system, the concentration of the melting fluxes is often too low to be effective, or too much media must be used to attain the required concentration level. Because of the low concentration, some water is usually mixed to the salt or the like to rapidly induce the melting process of the ice or snow. Moreover, if the truck is going at a too high speed, air turbulences created below the truck help even more to disperse the melting fluxes, often pushing them to roadsides where they are totally useless for the melting operation, but still damaging for the environment. Because of this, the truck must travel at a relatively low speed, notwithstanding which media is dispersed. The creation of traffic jams in urban road areas, and more importantly the potential increase of accidents on yet uncovered roadways by the melting operation truck are negative consequences of this low speed operational truck.

As it will be readily understood by anyone skilled in the art, a spreading device that would keep a certain concentration level of melting fluxes would effectively melt the ice initially on the covered area and would also quickly melt the surrounding surfaces. This would furthermore take into account the environmental and accomplishing speed factors.

OBJECTS OF THE INVENTION

It is therefore a general object of the present invention to provide a spreading device for confined application of grain type materials on roads that obviates the above noted disadvantages.

Another object of the present invention is to provide a spreading device for confined application of grain type materials that creates an effective method to melt ice with minimum damages to the environment.

A further object of the present invention is to provide a spreading device for confined application of grain type materials that decreases an overall quantity of melting materials necessary by increasing the material's concentration as the media is spread and laid down by a packing member to rest at specific locations (pre-determined paths) on the roads to efficiently start the melting process.

Still an object of the present invention is to provide a spreading device for confined application of grain type materials that is not affected by any air turbulence created between the truck and the road surface when the truck moves at high speed.

Yet another object of the present invention is to provide a spreading device for confined application of grain type materials that is relatively easy to adapt, install, use and manufacture, and that is not too expensive.

Yet a further object of the present invention is to provide a spreading device for confined application of grain type materials that can be folded when not in use.

Still another object of the present invention is to provide a spreading device for confined application of grain type materials that can be installed on vehicles already having a standard rotary disk spreader to allow for selective use of either the standard spreader or the spreader for confined application of grain materials.

Still a further object of the present invention is to provide a spreading device for confined application of grain type materials that also includes a standard rotary disk spreader to allow for selective use of either one.

Other objects and advantages of the present invention will become apparent from a careful reading of the detailed description provided herein, with appropriate reference to the accompanying drawings.

SUMMARY OF THE INVENTION

According to one aspect of the present invention, there is provided a spreading device for confined application of grain type materials along a well-defined path on a road from a conveyor of a storing tank mounted on a vehicle moving in a forward direction, said device comprises a chute member and a packing member mounted on either sides of said vehicle, said chute member being configured and sized for receiving said materials from said conveyor and substantially dropping said materials generally vertically under gravity directly on said road in proximity and in front of said packing member for stopping and packing said materials on said road along said path, whereby said materials are stopped relative to said road and confined along said path by said packing member as said vehicle moves ahead.

Preferably, the device further comprises a folding mechanism for pivotally securing said device to said vehicle, said folding mechanism positioning said device between an operative unfolded configuration and a non-operative folded configuration relative to said conveyor.

Preferably, the chute member is a generally elongated channel, the latter being inclined between an upper first end located along and adapted for fitting to a free extremity of a feeder of said conveyor and a lower free second end located in proximity of a roller of said packing member when in said operative configuration, said roller being adapted for packing said materials on said road when freely engaging said road in said operative configuration.

Preferably, the folding mechanism has a linear actuator with a first end pivotally secured to said packing member and a second end adapted for pivotally securing to a rigid frame of said vehicle, an elongated guiding member with a first and a second extremities pivotally connected to said packing member and to said chute member respectively, said chute member being adapted for pivotally securing to said conveyor.

Preferably, the guiding member has a third extremity rigidly connected to said first extremity and pivotally connected to said rigid frame of said vehicle, said second extremity being pivotally moving relative to said first and third extremities.

Preferably, the packing member is rigidly secured to said chute member.

Alternatively, the packing member is resiliently secured to said second end of said channel.

According to a second aspect of the present invention, the folding mechanism includes a shaft member for rotatably mounting said device on said conveyor and an actuator member rotating said shaft member and said device relative to said conveyor between said operative and non-operative configurations.

Preferably, the actuator member is a linear actuator having an actuating direction essentially perpendicular to an axis of said shaft member with a first end pivotally secured to said conveyor and a second end eccentrically connected to said shaft member.

Preferably, the chute member includes a non-moving part and a moving part rigidly secured to said conveyor and to said shaft member respectively, said non-moving part rotatably and pivotally supporting said shaft member and said first end of said linear actuator respectively, said non-moving part being an extension of said conveyor, receiving said materials from said conveyor and providing said materials to said moving part when said device is in said unfolded configuration.

Preferably, the chute member includes a curtain member for containing said materials in proximity and in front of said a roller of said packing member, said curtain member extending generally downwardly to a position adjacent the road, a front cylindrical portion of an outer surface of said roller forming a closed channel with said curtain member, said outer surface of said roller freely engaging said road in said operative configuration.

Preferably, the packing member includes a biasing member for biasing said roller against said road in said operative configuration.

Preferably, the device further comprises a support structure secured to said shaft member, said support structure supporting a generally horizontal rotary disk member for receiving said materials from said conveyor and widely spreading said materials on said road with a second actuator member spinning said disk member around its longitudinal axis when said device is in said folded configuration, whereby both said disk member and said second actuator member operate with said device in said folded configuration and both said chute member and said packing member operate with said device in said unfolded configuration.

Preferably, the support structure includes a lower part supporting both said disk member and said second actuator member and pivotally mounted on a second shaft with an axis substantially parallel to said direction of said linear actuator and for rotatably mounting said lower part to said conveyor and an upper part pivotally secured to said shaft member and said lower part at a first and a second extremities respectively, said upper part providing a cam action to pivot said lower part around an axis of said second shaft when said shaft member is rotated by said linear actuator, said disk member and packing member being alternately operating with said device in said folded and unfolded configurations respectively.

BRIEF DESCRIPTION OF THE DRAWINGS

In the annexed drawing, like reference characters indicate like elements throughout.

DETAILED DESCRIPTION OF THE PREFERRED EMBODIMENTS

With reference to the annexed drawings the preferred embodiments of the present invention will be herein described for indicative purposes by no means as of limitation.

Figure 1:
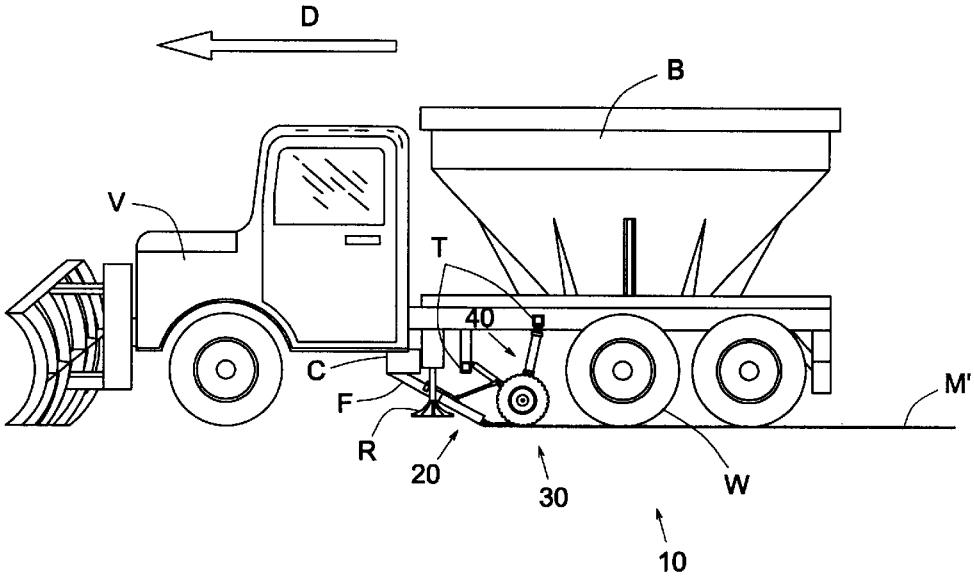
FIG. 1 is an elevation view of a first embodiment of a spreader device for narrow application of grain type materials according to the present invention mounted on a vehicle.
Figure 2:
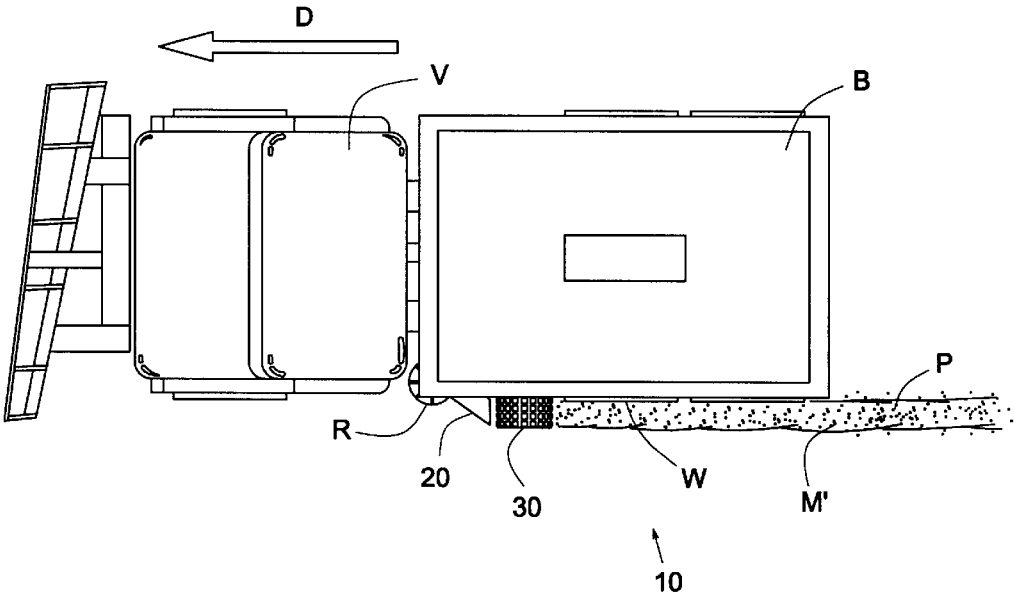
FIG. 2 is a top view of FIG. 1, showing the well-defined path of grain type material created by the first embodiment on the road.

FIGS. 1 and 2 show a first embodiment 10 of a spreading device for confined application of grain type materials M along a well-defined path P on a road supplied from a conveyor C of a storing tank B mounted on a vehicle V, in accordance with the present invention. The spreading device 10 is secured on a rigid frame T of the vehicle V (see FIG. 1) and includes a chute member 20 receiving materials M from the conveyor C and applying them on the road along a well-defined path P in proximity and in front of a packing member 30 for packing the same M on the road. The packing member 30 stops the material M at zero speed relative to the road and confines or packs it thereon, with relatively high concentration, along the path P such that the melting effect could start immediately when salt or the like material is used.

Figure 3:
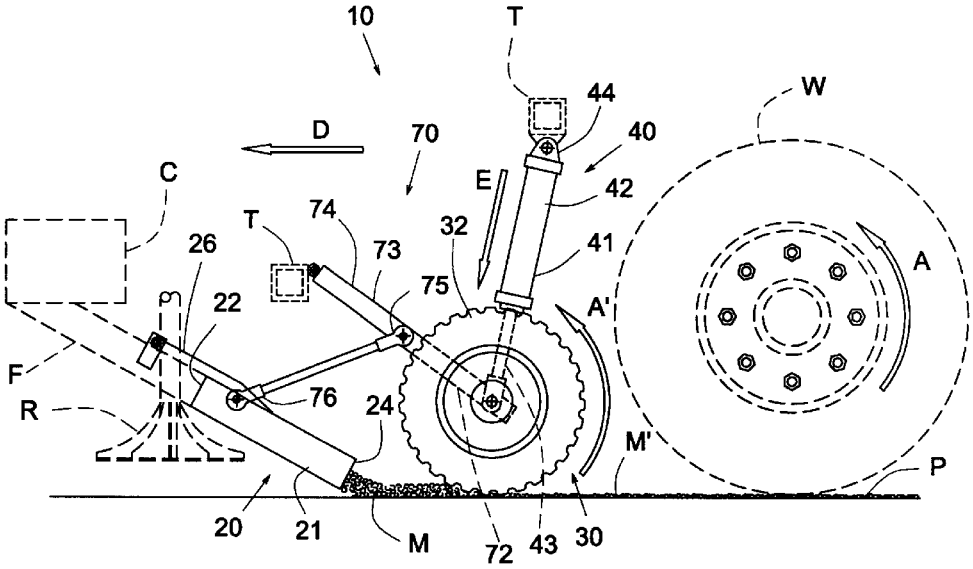
FIG. 3 is an enlarged elevation view taken along line 3 of FIG. 1, showing the embodiment in its unfolded operative configuration.
Figure 3A:
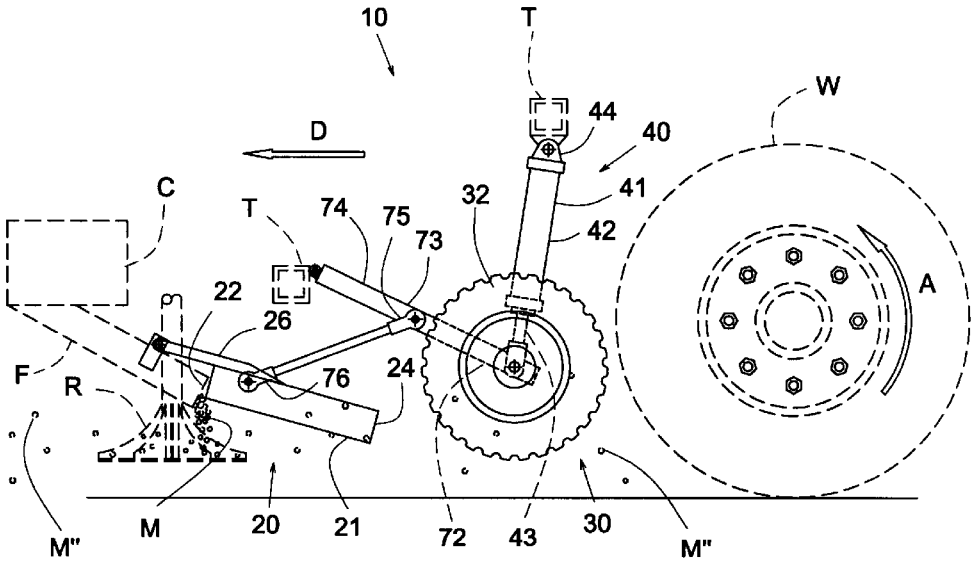
FIG. 3*a* is a view similar to FIG. 3, showing the embodiment in its folded non-operative configuration.

The device 10 also preferably includes a folding mechanism 40 for pivotally securing the device 10 to the vehicle and for positioning that device 10 between an operative unfolded configuration, as shown in FIG. 3, and a non-operative folded configuration, as shown in FIG. 3*a,* relative to the conveyor C (shown in dashed-lines in FIGS. 3 and 3*a*).

The chute member 20 is a generally elongated channel 21, the latter is inclined between an upper first end 22 located along and adapted for fitting to a free extremity of a feeder F of the conveyor C and a lower free second end 24 located in proximity and in front of a roller 32 of the packing member 30 when in said operative configuration. In the operative configuration, the roller 32 freely engages the road and is adapted for packing the materials M on the same (see FIG. 3). The feeder F is rearwardly oriented in a direction parallel to the forward movement direction D of the vehicle V, as shown in FIGS. 1 and 2.

The folding mechanism 40 has an actuator member 41, preferably a linear actuator 42 with a first end 43 pivotally secured to the packing member 30 and a second end 44 pivotally secured to a rigid frame T of the vehicle V, an elongated guiding member 70 with a first 72 and a second 76 extremities pivotally connected to the packing member 30 and to the chute member 20 respectively. The chute member 20 is itself pivotally connected to the feeder F with member 26.

In order to be stronger, the guiding member 70 preferably has a third extremity 74 rigidly connected to the first extremity 72 via bar 73 and pivotally connected to the rigid frame T of the vehicle V. Accordingly, the second extremity 76 is pivotally connected to a substantially central location of the bar 73 via link 75. The linear actuator 42 is preferably a hydraulic ram 46 with an expansion direction indicated by arrow E in FIG. 3. The linear actuator 42 could also be of some type of pressure-adjustable jack (not shown).

The chute member 20 is pivotally secured to the feeder F (see FIG. 3*a*) and can be positioned, when the linear actuator 42 is extended, in a matching position with the feeder F to essentially operate as an extension to the standard feeder F. When the spreading device 10 is in its operating position, the lower free second end 24 of the chute member 20 away from the feeder F is so positioned 83 to be close to the roadway and to precede the packing member 30. The width (not shown) of the second end 24 of the chute member 20 is variable but is preferably of a same width as the packing member 30.

When the spreading device 10 is in operating unfolded configuration, the materials M come down from the feeder F into the chute member 20 and are laid on the road just in front of the packing member 30. Preferably, the spreading device 10 is mounted on either (or both) side(s) of the vehicle, in front of and in line with its rear wheels W so as to first melt the ice (or snow) in the normal wheel tracks of the motorized vehicles traveling on the road. Since the vehicle V is moving in the direction D, the wheels W of the vehicle V rotate along direction A.

Referring to FIG. 3, since the roller 32 touches the road, it is frictionally driven in a same direction A'. The material M is effectively compressed under the roller 32, which readily improves its effectiveness and its response time since it does not only spread the materials M on the ice (or snow), but also partially embeds it into the ice as well. As it can be readily understood by anyone skilled in the art, this compressed materials M' is furthermore very effective to melt the ice covering the roadways along the path P since the concentration of compressed materials M' along the path P could be controlled to an appropriate and known level, mainly depending on the speed of the vehicle V. It is also important to note that due to the close proximity of the chute member 20 and of the packing member 30, even if the vehicle V travels at high speed, the air turbulence usually felt underneath the vehicle V does not really affect the way the materials M is spread along the path P of the road. A vehicle V moving fast shall also cover more distance for any given time than a slow vehicle V.

Although a roller 32 is preferably used, any other type of packing member 30 could be considered such as an inclined blade, biased or not, sliding on the surface of the road, or the like that can stop and at least partially pack the material M on the road along a path P.

As illustrated in FIG. 3*a,* the linear actuator 42 of the spreading device 10 in its non-operative or retracted configuration has been retracted in order to raise the roller 32 off the roadway and the chute member 20 that away from the feeder F thus freeing up the same. In such a situation, the standard rotary disk R can be optionally used, as shown, spreading the material M" that falls from the feeder F and flies in a non-uniform random fashion in all directions and over a large surface of the roadway. This standard disk R disperses the abrasive material M" with unknown concentration levels for one particular area of the roadway, as well as probably spreading some material M" in the ditches alongside the roads, due to the air turbulence under the vehicle V if the latter moves at a high speed, where the material M" becomes totally ineffective and lost.

Many variations of the chute member 20 and of the packing member 30 can be used. More than one chute member 20 can also be considered (not shown).

Figures 4, 6:
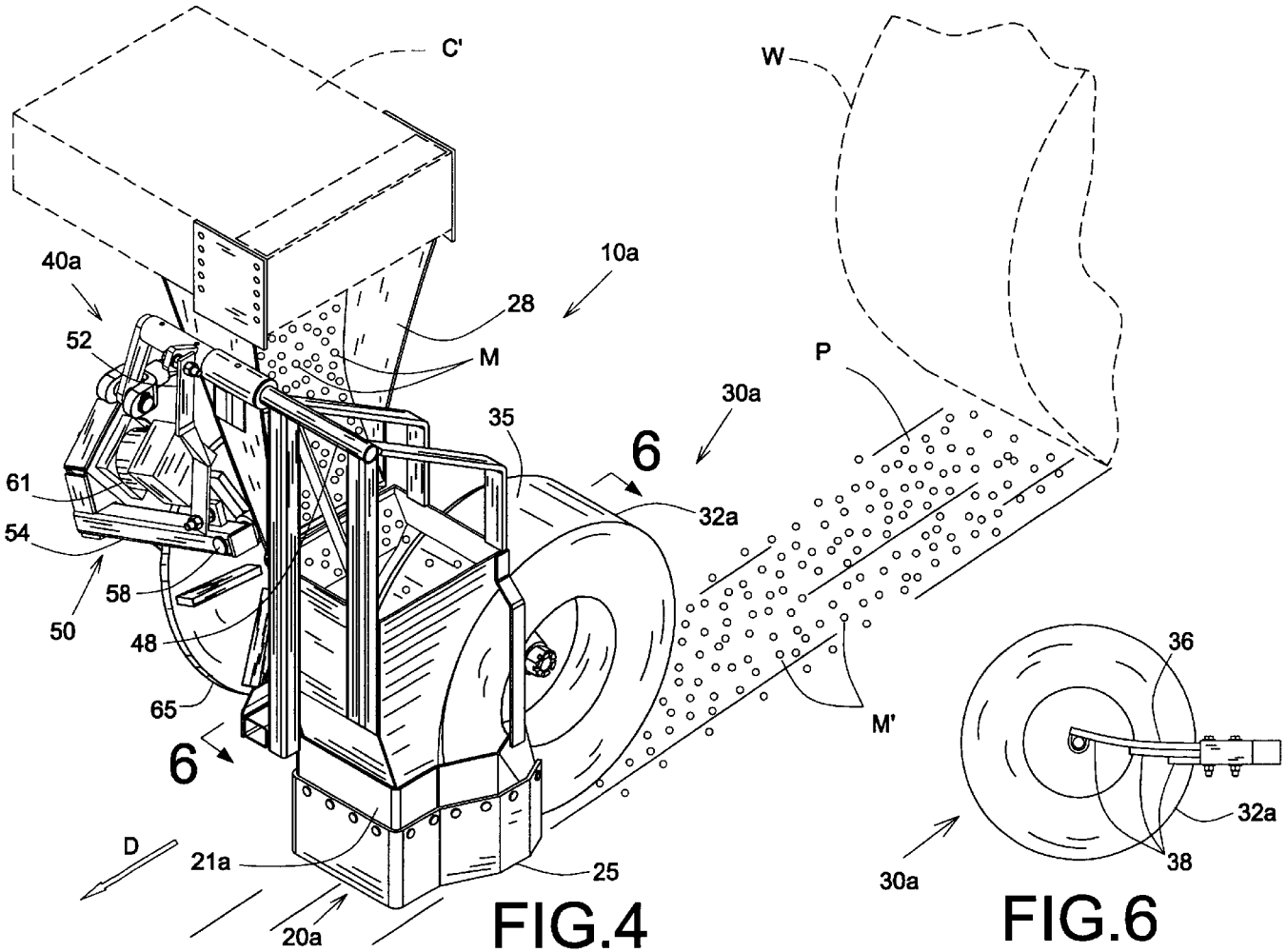
FIG. 4 is a front perspective view a second embodiment of a spreader device for narrow application of grain type materials according to the present invention mounted on a vehicle in the unfolded operative configuration and with additional standard rotary disk spreader in a retracted configuration.
FIG. 6 is an enlarged section view taken along line 6—6 of FIG. 4, showing the spring arm supporting and biasing the roller against the road.
Figure 5:
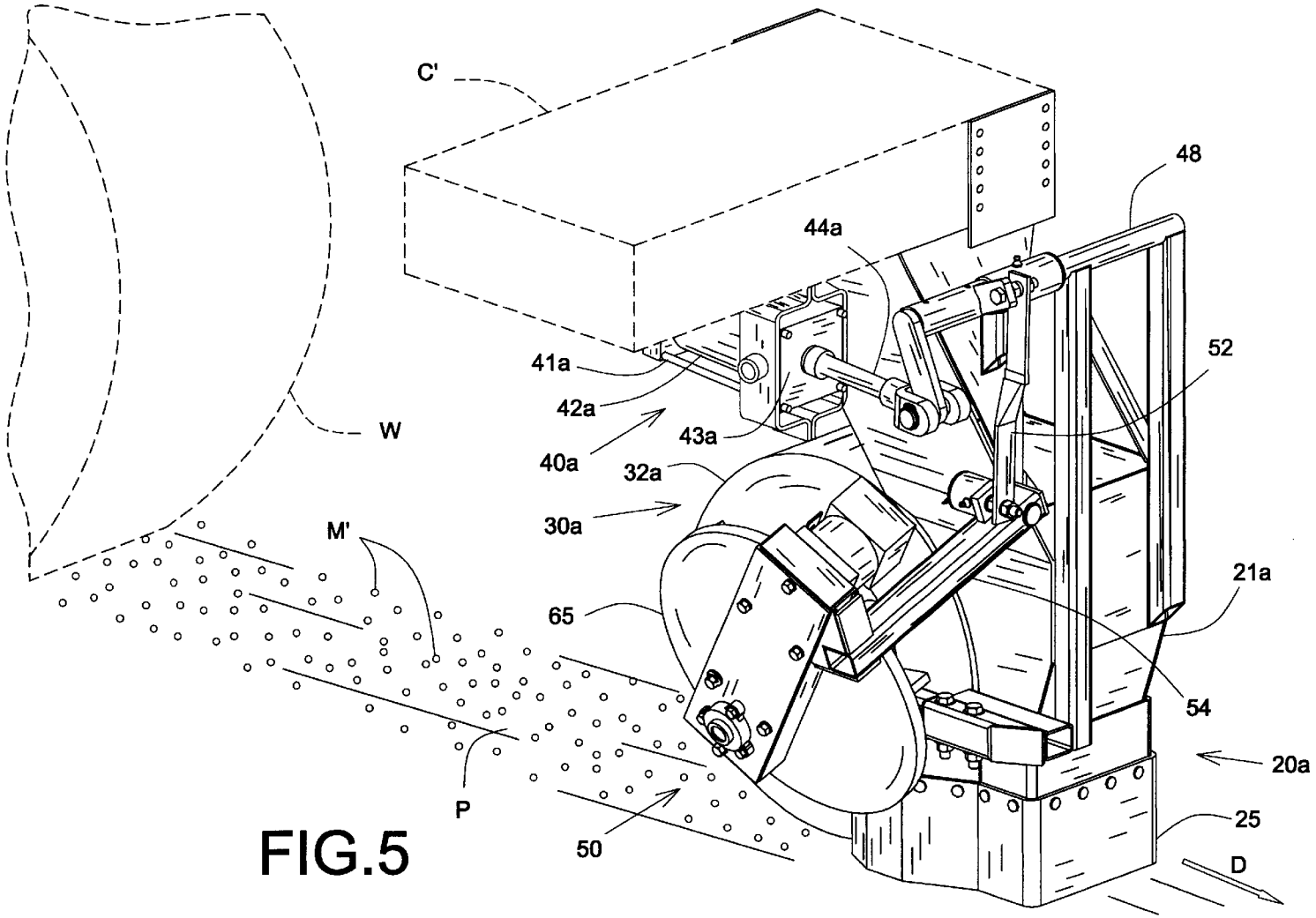
FIG. 5 is a back perspective view of the second embodiment of FIG. 4.

Referring to FIGS. 4 to 6, there is shown a second embodiment 10*a* of a spreading device for confined application of grain type materials M in accordance with the present invention. The folding mechanism 40*a* of the spreader device 10*a* includes an actuator member 41*a* rotating a shaft member 48 and the device 10*a* relative to the conveyor C' of the vehicle V between said folded and unfolded configurations. The conveyor C' is, in this case, oriented transversely to the vehicle V in a direction generally perpendicular to the direction D and substantially parallel to the axis of the shaft 48.

The actuator member 41*a* of the device 10*a* is a linear actuator 42*a* having an actuating direction generally perpendicular to an axis of the shaft member 48 with a first end 43*a* adapted for securing to the conveyor C' and a second end 44*a* eccentrically (or off-axially) connected to the shaft member 48.

The chute member 20*a* of the device 10*a* includes a curtain member 25 or any protective guard and the like, preferably made out of rubber type material, just above the road surface for containing materials M in proximity and in front of the roller 32*a* of the packing member 30*a* such that the confined application of grain type materials is not affected by any air turbulence which could generated between the vehicle V and the road surface when the vehicle V moves at high speed. A front portion of the cylindrical outer surface 35 of the roller 32*a* forms a closed channel with the curtain member 25. The surface of the roller 32*a* also freely engages the road in the operative configuration.

As shown in FIG. 6, the packing member 30*a* can also include a biasing member 36 such as spring bars 38 for biasing the roller 32*a* against the road in the operative configuration. The biasing member 36 could also be other type of springs or the like.

When the device 10*a* is mounted on a vehicle not having a standard rotary disk spreader R, it preferably further includes a support structure 50 secured to the shaft member 48 and supporting a generally horizontal rotary disk member 65 (similar to a standard rotary disk R) receiving materials M from the conveyor C' and widely spreading the same on the road with a second actuator member 61, preferably a rotary motor, spinning the disk member 65 around its own axis when the device 10*a* is in the folded configuration. Accordingly, both the disk member 65 and the second actuator member 61 are operating with the device 10*a* in the folded configuration, and both the chute member 20*a* and the packing member 30*a* are operating with the device 10*a* in the unfolded configuration, such that either spreader can selectively be used upon the need.

Both the disk member 65 and the second actuator member 61 are supported by a lower part 54 of the support structure 50 pivotally mounted on a second shaft 58 with an axis substantially parallel to the direction of the linear actuator 42*a* (and the direction D). The second shaft 58 is secured to a nonmoving element relative to the conveyor C', and preferably to the latter. An upper part 52 of the support structure 50 is pivotally secured to both the shaft member 48 and the lower part 54 at a first 53 and a second 55 extremities respectively. The upper part 52, being eccentrically mounted to the lower part 54, provides a cam action to pivot the lower part 54 around an axis of the second shaft 58 when the shaft member 48 is rotated by the linear actuator 42*a*. Whereby the disk member 65 and roller 32*a* are selectively and alternatively operating with the device 10*a* in the folded and unfolded configurations respectively.

Preferably, both the shaft member 48 and the second shaft 58 are rotated by seventy (70) to ninety (90) degrees, preferably approximately eighty (80) degrees, around their respective axis upon activation of the linear actuator 42*a*.

Alternatively, it would be obvious to one having ordinary skill in the art to have the chute 20*a* and packing 30*a* members as well as the support structure 50 and its rotary disk member 65 all rotating around the same axis, namely the axis of the shaft member 48, or any other possible orientation.

Preferably, the chute member 20 includes a non-moving funnel part 28 that is an extension of the conveyor C' of the vehicle V and rigidly mounted on the same. Accordingly, the non-moving part of the linear actuator 42*a* and the shaft 48 are preferably pivotally and rotatably secured to the funnel 28 respectively, instead of being secured to the conveyor C' integral to the vehicle V.

In the operative unfolded configuration (see FIGS. 4 and 5), the device 10*a* chute member 20*a* confines the grain type materials M in front of the roller 32*a* to be packed by the same. The folding mechanism may be a cam mechanism (not shown), different eccentric mechanisms or the like.

Figure 4A:
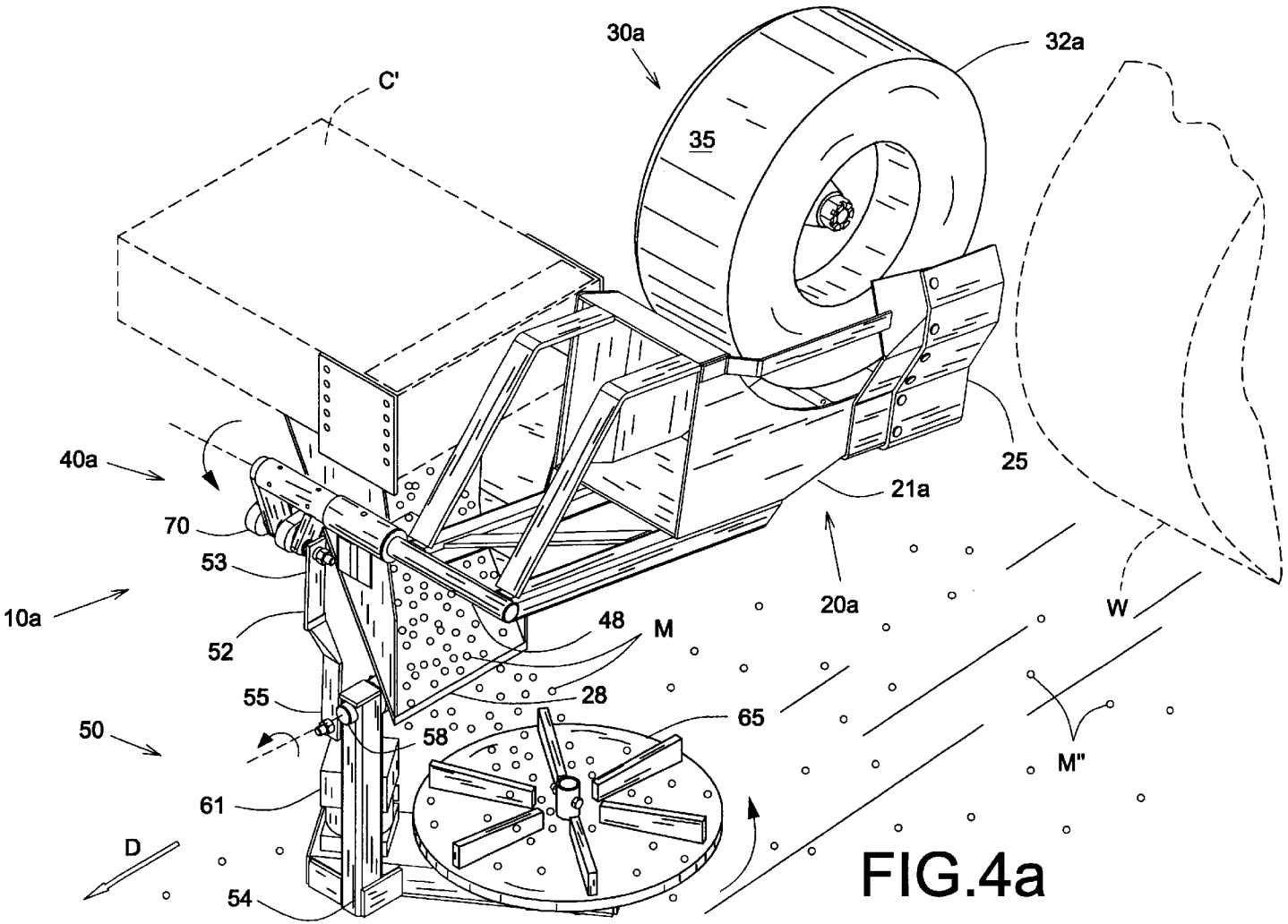
FIG. 4*a* is a view similar to FIG. 4, showing the second embodiment in the folded non-operative configuration and with the additional standard rotary disk spreader in the operating configuration.

When it is necessary to apply the materials M in a non-uniform way (see FIG. 4*a*), the spreading device 10*a* is folded in the non-operative configuration by the folding mechanism 40 and the materials M" fall directly from the conveyor C' to the operating rotary disk member 65 to be widely and randomly spread on the road.

If an abrasive materials M is furthermore used with the spreading device 10,10*a*, passing vehicles will effectively disperse the compressed media M' over the road surface from the path P. It shall also be noted that there is also an additional crushing and mixing effect from the packing member 30,30*a*. Also, the packing member 30,30*a* can bring small amount of snow above the ice, and this will prove to be more effective and have a better time-response when the snow is mixed with the materials M above the ice.

The chute member 20,20*a* spreads the materials M' with a relatively high concentration along a well-defined path P on the road. A higher concentration of materials M like this enables a faster melting of the ice covering the road surface under the path P. Surrounding areas to the path P will also quickly melt afterwards.

The packing member 30,30*a* is a compacting roller 32,32*a*, or a simple wheel with a free rolling action induced by the friction action with the road. The biasing member 36 improves on maintaining that friction as well as the reliability of the device 10*a* (see FIG. 6).

The materials used for all presented elements of the spreading device 10,10*a* shall be resistant enough to sustain the required forces, and shall be corrosion resistant for long life.

Although the present spreading device for confined application of grain type materials on roads has been described with a certain degree of particularity it is to be understood that the disclosure has been made by way of example only and that the present invention is not limited to the features of the embodiments described and illustrated herein, but includes all variations and modifications within the scope and spirit of the invention as hereinafter claimed.

I claim:

1. A spreading device for confined application of grain type materials along a well-defined path on a road from a conveyor of a storing tank mounted on a vehicle moving in a forward direction, said device comprising chute member and a packing member mounted on either said of said vehicle, said chute member being configured and sized for receiving said materials from said conveyor and substantially dropping said materials generally vertically under gravity directly on said road in proximity and in front of said packing member for stopping and packing said materials on said road along said path, whereby said materials are stopped relative to said road and confined along said path by said packing member as said vehicle moves ahead.

2. A device as defined in claim 1, further comprising a folding mechanism pivotally securing said device to said vehicle, said folding mechanism allowing positioning said device into an operative unfolded configuration from a non-operative folded configuration relative to said conveyor.

3. A device as defined in claim 2, wherein said folding mechanism includes a shaft member for rotatably mounting said device on said conveyor and an actuator member rotating said shaft member and said device relative to said conveyor between said operative and non-operative configurations.

4. A device as defined in claim 3, wherein said actuator member is a linear actuator having an actuating direction substantially perpendicular to an axis of said shaft member with a first end pivotally secured to said conveyor and a second end eccentrically connected to said shaft member.

5. A device as defined in claim 4, wherein said chute member includes a non-moving part and a moving part rigidly secured to said conveyor and to said shaft member respectively, said non-moving part rotatably and pivotally supporting said shaft member and said first end of said linear actuator, respectively, said non-moving part being an extension of said conveyor, receiving said materials from said conveyor and providing said materials to said moving part when said device is in said unfolded configuration.

6. A device as defined in claim 4, wherein said chute member includes a curtain member for containing said materials in proximity and in front of a roller of said packing member, said curtain member extending generally downwardly to a position adjacent the road, a front cylindrical portion of an outer surface of said roller forming a closed channel with said curtain member, said outer surface of said roller freely engaging said road in said operative configuration.

7. A device as defined in claim 6, wherein said packing member includes a biasing member for biasing said roller against said road in said operative configuration.

8. A device as defined in claim 4, further comprising a support structure secured to said shaft member, said support structure supporting a generally horizontal rotary disk member for receiving said materials from said conveyor and widely spreading said materials on said road with a second actuator member spinning said disk member around its longitudinal axis when said device is in said folded configuration, whereby both said disk member and said second actuator member operate with said device in said folded configuration and both said chute member and said packing member operate with said device in said unfolded configuration.

9. A device as defined in claim 8, wherein said support structure includes a lower part supporting both said disk member and said second actuator member and pivotally mounted on a second shaft with an axis substantially parallel to said direction of said linear actuator and for rotatably mounting said lower part to said conveyor and an upper part pivotally secured to said shaft member and said lower part at a first and a second end thereof, respectively, said upper part providing a cam action to pivot said lower part around an axis of said second shaft when said shaft member is rotated by said linear actuator, said disk member and packing member being alternately operating with said device in said folded and unfolded configurations, respectively.

10. A device as defined in claim 9, wherein said shaft member and said second shaft are both rotated between about seventy and about ninety degrees around their respective axis upon activation of said linear actuator.

11. A device as defined in claim 1, wherein said packing member is rigidly secured to said chute member.

12. A device as defined in claim 1, wherein said chute member includes a curtain member for containing said materials in proximity and in front of said packing member, said curtain member extending generally downwardly to a position adjacent the road, a front cylindrical portion of an outer surface of said packing member forming a closed channel with said curtain member, said outer surface of said packing member freely engaging said road in said operative configuration.

13. A spreading device for confined application of grain type materials along a well-defined path on a road from a conveyor of a storing tank mounted on a vehicle moving in a forward direction, said vehicle having a wheel engaging said road, said device comprising a chute member mounting on either said of said vehicle, said chute member being configured and sized for receiving said materials from said conveyor and substantially dropping said materials generally vertically under gravity directly on said road in proximity and in front said wheel for stopping and packing said materials on said road along said path, whereby said materials are stopped relative to said road and confined along said path by said wheel as said vehicle moves ahead.

14. A device as defined in claim 13, wherein said chute member includes a curtain member for containing said materials in proximity and in front of said wheel, said curtain member extending generally downwardly to a position adjacent the road, a front cylindrical portion of an outer surface of said wheel forming a closed channel with said curtain member.

* * * * *